US008904719B2

(12) United States Patent
Knapp

(10) Patent No.: US 8,904,719 B2
(45) Date of Patent: Dec. 9, 2014

(54) FASTENING DEVICE FOR GLASS PANES

(76) Inventor: Friedrich Knapp, Bad Kreuzen (AT)

( * ) Notice: Subject to any disclaimer, the term of this patent is extended or adjusted under 35 U.S.C. 154(b) by 0 days.

(21) Appl. No.: 13/117,453

(22) Filed: May 27, 2011

(65) Prior Publication Data

US 2012/0204504 A1 Aug. 16, 2012

Related U.S. Application Data

(63) Continuation of application No. 12/935,163, filed as application No. PCT/IB2009/005697 on Apr. 2, 2009, now abandoned.

(30) Foreign Application Priority Data

Apr. 2, 2008 (DE) ..... 10 2008 017 169
Sep. 17, 2008 (DE) ..... 10 2008 047 799

(51) Int. Cl.
*E06B 3/30* (2006.01)
*E06B 3/984* (2006.01)
*E04C 2/38* (2006.01)
*E06B 3/58* (2006.01)

(52) U.S. Cl.
CPC ..... *E06B 3/5828* (2013.01); *E06B 3/5842* (2013.01)
USPC ..... 52/204.53; 52/204.69; 52/718.04

(58) Field of Classification Search
USPC ..... 52/204.53, 204.55, 204.61, 504.62, 52/204.63, 204.69, 204.591, 202, 203, 52/707.01, 718.04, 285.1, 256
See application file for complete search history.

(56) References Cited

U.S. PATENT DOCUMENTS

| | | | | |
|---|---|---|---|---|
| 4,525,966 | A * | 7/1985 | Litchfield et al. | 52/204.591 |
| 4,702,050 | A * | 10/1987 | Giguere | 52/202 |
| 4,982,530 | A * | 1/1991 | Palmer | 49/504 |
| 5,138,811 | A * | 8/1992 | Parrott | 52/204.597 |
| 5,692,349 | A * | 12/1997 | Guillemet | 52/204.53 |
| 5,836,119 | A * | 11/1998 | Emmanuel | 52/204.71 |
| 6,643,987 | B2 * | 11/2003 | Rusch et al. | 52/506.05 |
| 6,848,225 | B2 * | 2/2005 | Lapierre | 52/204.53 |
| 7,877,939 | B2 * | 2/2011 | Knapp | 52/204.53 |
| 2007/0256375 | A1 * | 11/2007 | Fountas | 52/204.53 |
| 2011/0120032 | A1 * | 5/2011 | Kernander | 52/203 |

FOREIGN PATENT DOCUMENTS

| | | |
|---|---|---|
| DE | 38 09 384 A1 | 9/1989 |
| DE | 42 16 260 C2 | 10/1993 |
| DE | 195 25 206 | 1/1996 |
| DE | 296 00 399 U1 | 4/1996 |

(Continued)

*Primary Examiner* — Elizabeth A Plummer
(74) *Attorney, Agent, or Firm* — Henry M. Feiereisen LLC

(57) ABSTRACT

A fastening device for fastening glass panes in a wooden or plastic frame includes a plastic retaining rail fixable on the frame, and a clip strip mountable onto the retaining rail. The retaining rail has a fastening arm with a claw connectable with the frame by fasteners, and a clamping arm at a distance to the fastening arm. The clip strip has a groove for form-lockingly receiving the clip claw, and a groove for force-lockingly and/or form-lockingly receiving the clamping arm. The clip strip is form-lockingly held by the pre-stressed clamping arm and a free, non-secured section of the retaining rail is pressed against the glass pane by a permanent stressing force such that a seal between the retaining rail and the glass pane is pressed against the glass pane and the glass pane is pressed against a seal between the backside thereof and the stop of the frame.

6 Claims, 6 Drawing Sheets

(56) References Cited

FOREIGN PATENT DOCUMENTS

| | | | | | |
|---|---|---|---|---|---|
| DE | 199 55 639 | A1 | | 5/2001 | |
| GB | 2233698 | A | * | 1/1991 | ..... E06B 3/58 |
| GB | 2241529 | A | * | 9/1991 | ..... E06B 3/58 |
| GB | 2254357 | A | * | 10/1992 | ..... E06B 3/58 |
| GB | 2290577 | A | * | 1/1996 | ..... E06B 3/58 |
| GB | 2 345 938 | A | | 7/2000 | |
| WO | WO 2006105774 | A1 | * | 10/2006 | |

* cited by examiner

FASTENING DEVICE FOR GLASS PANES

CROSS-REFERENCES TO RELATED APPLICATIONS

This application is a continuation of prior filed U.S. application Ser. No. 12/935,163, filed Sep. 28, 2010 now abandoned, the priority of which is hereby claimed under 35 U.S.C. §120, which in turn is the U.S. National Stage of International Application No. PCT/IB2009/005697, filed Apr. 2, 2009, which designated the United States and has been published as International Publication No. WO 2009/122305, and which claims the priority of German Patent Applications, Serial Nos. 10 2008 017 169.7, filed Apr. 2, 2008, and 10 2008 047 799.0, filed Sep. 17, 2008, pursuant to 35 U.S.C. 119(a)-(d).

BACKGROUND OF THE INVENTION

The invention relates to a fastening device for fastening preferably glass panes in a frame construction made of wood or plastic. For fastening glass panes in window frames, among other things, so-called clip strip structures are used, such as described in DE 195 25 206, DE 296 00 399 U1, DE 42 16 260 C2 or DE 199 55 639 A1.

With such constructions, it is necessary that the glass panes are held in the frame very reliably. As frames made of aluminum are concerned, several profiles are used, which, together with rubber seals, enable good sealing and stability to be gained over a long period of time. However, now as before, window frames made of wood are used, and with such frames also, high sealing capability is required increasingly. Arrangements like those known from frames of aluminum can not be used for frames of wood, because the production of such frames is more time-consuming and costly than that of frames of wood.

SUMMARY OF THE INVENTION

Therefore, object of the invention is to provide a fastening device for fastening glass panes in a wooden or plastic frame, which is superior to any of the conventional clip strip structures with respect to sealing capability and stability and, nevertheless, can be made in a cost-effective way.

According to one aspect of the invention, the object is attained by a fastening device for glass panes to be held in a wooden or plastic frame having a rear stop to which the glass pane is pressed by the fastening device which includes a retaining rail made of an elastic, that is, resilient plastic, which can be fixed on a wooden or plastic frame. An expert will chose a plastic material comprising an elastic rigidity such as technologically required for the temperature range considered. Besides, the plastic material must keep its elastic rigidity over the period of time in which the window is used, that is, it must have properties such that it is not deformed plastically and does not lose its elasticity when exposed to heat. Also, the plastic material chosen must have properties such that it does not become brittle or does not rupture when exposed to temperatures below zero degrees centigrade. Several plastic materials are available so that an expert can select the most suitable one.

The kind of fastening is chosen by an expert at his discretion. Preferred kinds of fastening are defined in sub-claims, such as fastening by shooting nails into the frame. A clip strip can be slipped onto the retaining rail so that a formfit is made. An elastic sealing each is provided between one side of the glass pane and the rear stop of the frame and the other side of the glass pane and the retaining rail. The retaining rail has a fastening arm provided with a clip claw. In addition, the retaining rail has a clamping arm. The fastening arm and the clamping arm extend perpendicularly to the glass pane, in the main, and in a predetermined distance to each other. The clip strip is provided with a groove arranged and geometrically dimensioned so that, when the clip strip and the retaining rail are in the connected state, the clip claw engages into this groove in a formfitting manner. In addition, the clip strip is provided with another groove arranged and geometrically dimensioned so that, when the clip strip and the retaining rail are in the connected state, the clamping arm is in engagement with this groove by an interference fit or a combination of interference fit and formfit.

Especially, it must be mentioned that the geometries of the retaining rail and the clip strip are chosen so that the clip strip is firmly held and the non-fixed section of the retaining rail is permanently pressed against the glass pane as soon as the clip strip is clipped onto the retaining rail. Thereby, the seal arranged between the vertical section of the retaining rail and the glass pane is pressed against the glass pane. Simultaneously, the glass pane is pressed against the seal arranged between back side thereof and the stop provided on the frame. Effected by the formfitting junction between the clip claw of the retaining rail and the respective groove in the clip strip, the fastening device can not become loose. As the retaining rail and the seals are slightly elastic, a permanent pressure against the glass pane is generated by them, which is permanently maintained by the formfit.

Furthermore, the invention is advantageous in that the assembly, in which the clip strip and the retaining rail engage one into another, is a very rigid unit which can not loosen of itself and, therefore, the glass panes are fixedly held in the frame when being caused to vibrate continuously by wind, and also the fastening device does not become loose.

The clamping arm is provided with a claw which engages into the respective groove in the clip strip to set up an interference fit and a formfit. Thereby, a still better connection of the clip strip with the retaining rail and, thus, a more reliable clamping of the glass pane is gained.

The clamping arm comprises holes for receiving fixing screws. It is well known that screws enable especially reliable connections to be gained.

The fastening arm comprises a nail groove which serves as guide for driving in nails manually or for employing a nailing device reliably.

An expert knows that the clamping arm may have a combination of holes for receiving fixing screws with such a nail groove.

The fastening arm comprises a fastening web. Such a fastening web requires a respective groove to be cut into the window frame.

The bottom surface of the retaining rail is provided with a depression for receiving a sealing lip or a seal tape. With this arrangement, an effective water vapor lock is gained because the retaining rail is pressed onto the window frame by means of a high pressure.

The seals are fixedly connected with the retaining rail, that is, they are integral parts thereof. This enables the fastening device to be mounted quickly. This is the best embodiment of the invention. Seals fixedly connected with the retaining rail are always held at the accurate position and can not get out of place, compared with structures where the seals have to be inserted manually when the fastening device is mounted, with mounting errors possibly occurring.

According to another aspect of the invention, the object is attained by a method for producing a fastening device, wherein the retaining rail is made according to an extrusion process, in which the seal is simultaneously formed on it.

BRIEF DESCRIPTION OF THE DRAWING

In the following, the invention will be explained in detail by means of drawings, wherein parts or sections having the same features are marked by the same reference symbols.

DETAILED DESCRIPTION OF PREFERRED EMBODIMENTS

Figure 1A:
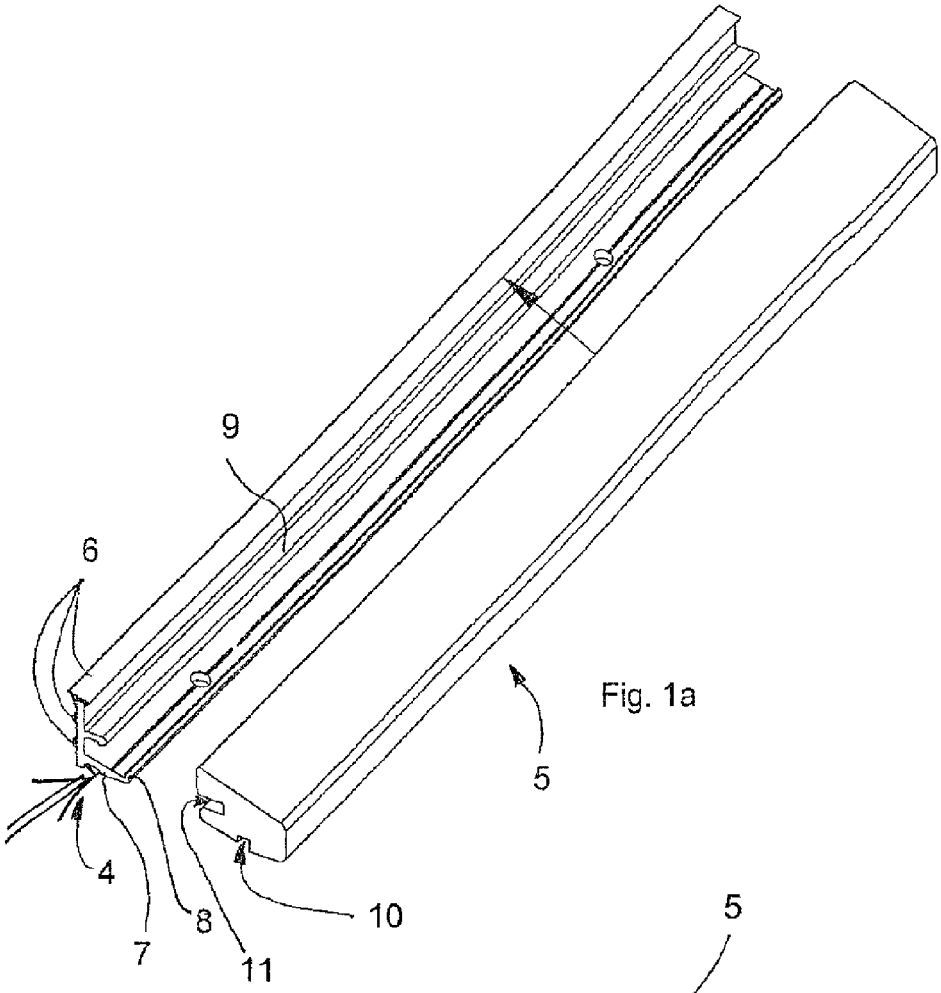
FIGS. 1*a*, 1*b*, 1*c*, 1*d* show a first fastening device for glass panes.
Figure 1B:
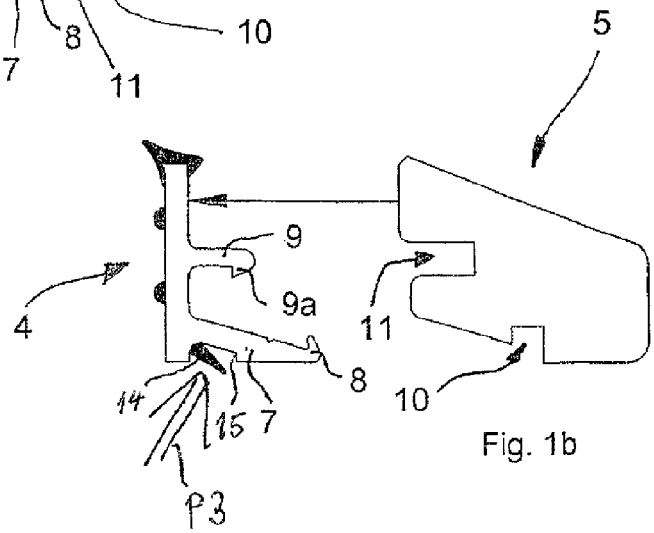

FIG. 1*a* is a perspective view of a retaining rail 4 made of plastic material and of a clip strip 5 made of wood or plastic material. FIG. 1*b* shows a cross-sectional view of the retaining rail 4 and the clip strip 5. The arrow indicates that the clip strip 5 is pushed onto the retaining rail 4.

Figure 1C:
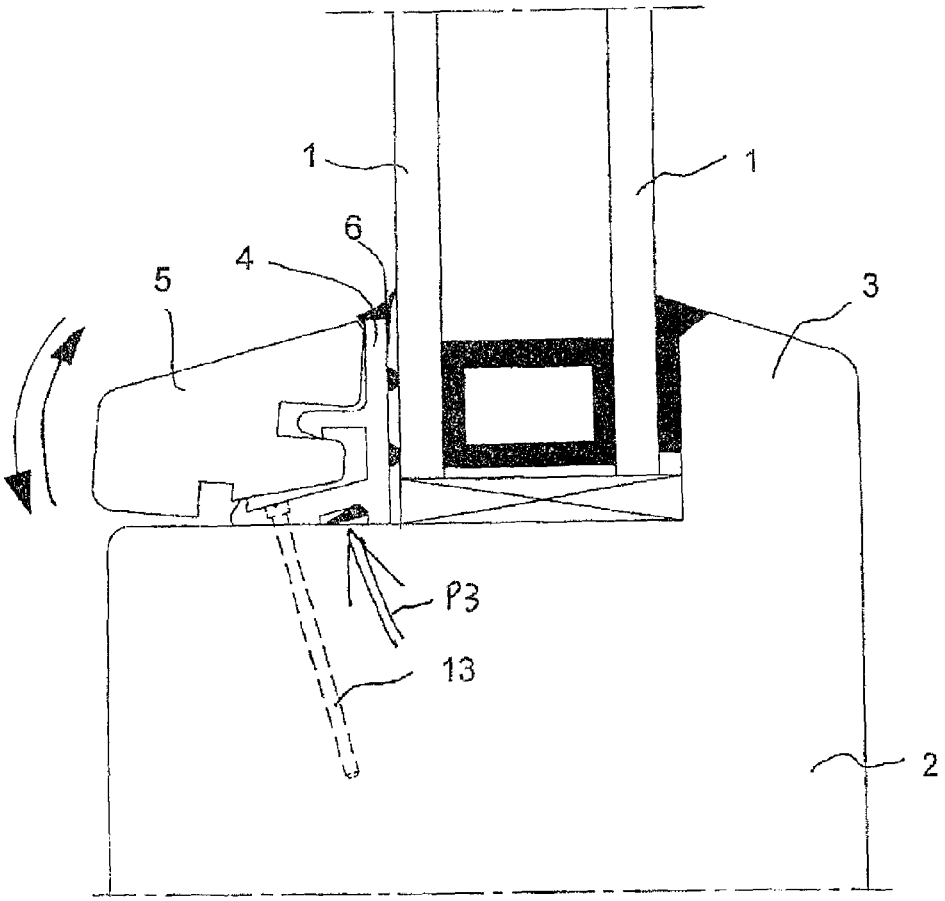

FIG. 1*c* shows the mounting of the clip strip 5 onto the retaining rail 4. Reference symbol 2 marks the cross section of a window frame having a rear stop 3 against which a compound arrangement of two glass panes 1,1 is pressed. The retaining rail is fastened to the window frame by nails 13 through its fastening arm 7. A clip claw 8 is formed at the outermost end of the fastening arm 7. A clamping arm 9 with a claw 9*a* formed at the outermost end thereof extends outwardly and in a predetermined distance to the fastening arm 7. The clip strip 5 comprises two grooves, a groove 10 for receiving the fastening arm 7, which is arranged and geometrically shaped so that, when the fastening arm 7 is inserted, its claw 8 is in engagement with the groove 10 in a formfitting manner, and a groove 11 for receiving the clamping arm 9, which is arranged and geometrically shaped so that, when the clamping arm 9 is inserted, its claw 9*a* is in engagement with the groove 11 by an interference fit and a formfit. The cross-sectional geometry of the clip strip 5 enables this strip to be mounted onto the clamping arm easily, caused by its inclined bottom surface, that is, the clip strip 5 is pushed onto the retaining rail 4 until the clip claw 8 snaps into the groove 10. When the clip strip 5 is pushed onto the retaining rail 4, it is slightly tilted upwardly, but tilts downwardly again as soon as the clip claw 8 snaps into the groove 10, as indicated by the two arrows. The geometries of the grooves and the arms are chosen so that the clamping arm 9 remains slightly tilted upwardly when the clip strip 5 has reached its final position. This is a substantial feature of the invention.

Figure 1D:
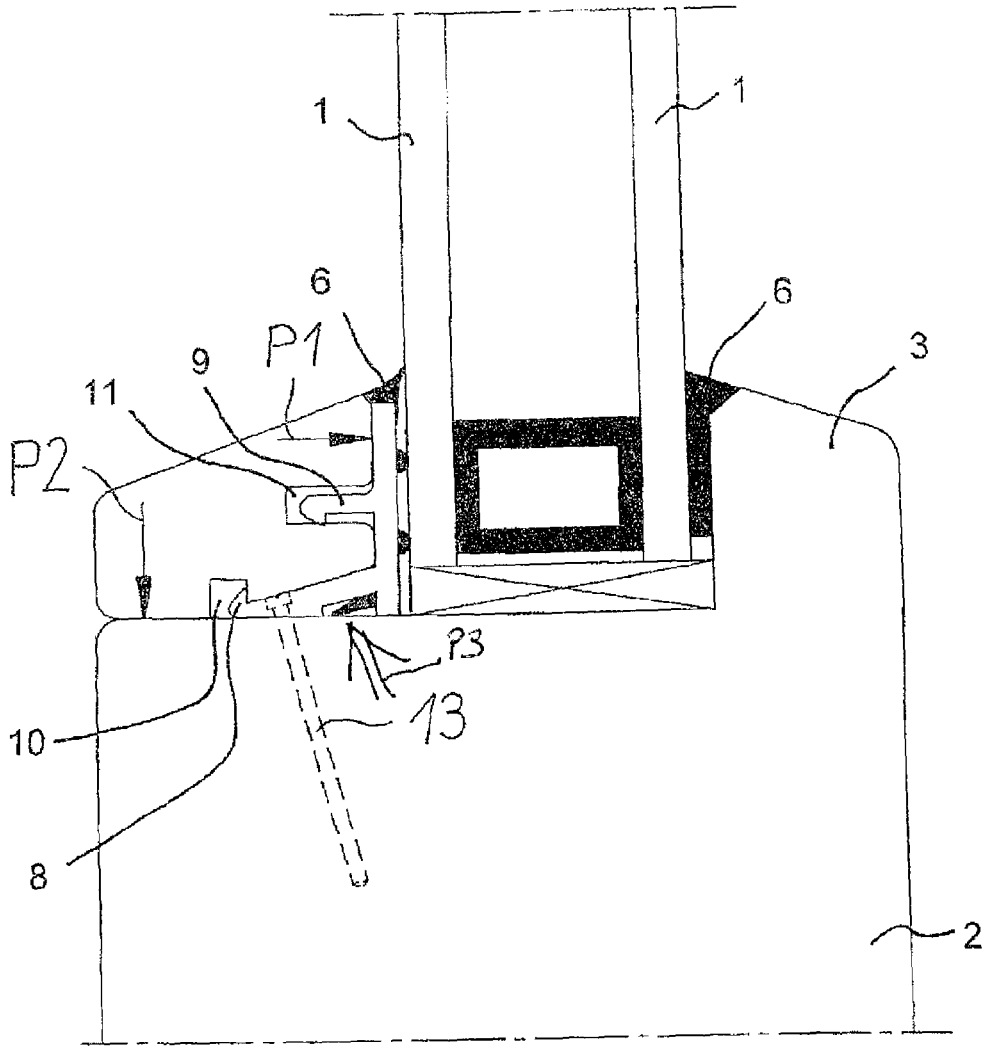

FIG. 1*d* shows the state when assembling is completed, that is, when the clip claw 8 is in engagement with the groove 10. Arrow P1 indicates that the vertical section of the retaining rail 4 is permanently pressed against the glass pane 1 to thereby press seals 6 against the glass pane 1 and, simultaneously, the backside of the glass pane 1 is pressed against the rear stop 3 of the frame 2 via further seals 6. Caused by the formfit between the clip claw 8 and the groove 10, this permanent contact pressure is maintained. Arrow P2 indicates that the clip strip 5 is pressed onto the frame 2 and, in a formfitting manner, onto the retaining rail, effected by the elastic force of the pre-stressed clamping arm 9. A sealing lip or a sealing tape 14, provided in a depression 15 in a bottom surface of the retaining rail 4 provides an effective water vapor lock as the retaining rail 4 is pressed onto the frame 2 under high pressure, as indicated by arrow P3. This is shown in FIGS. 1*b*, 1*c*, 1*d*.

Figure 2A:
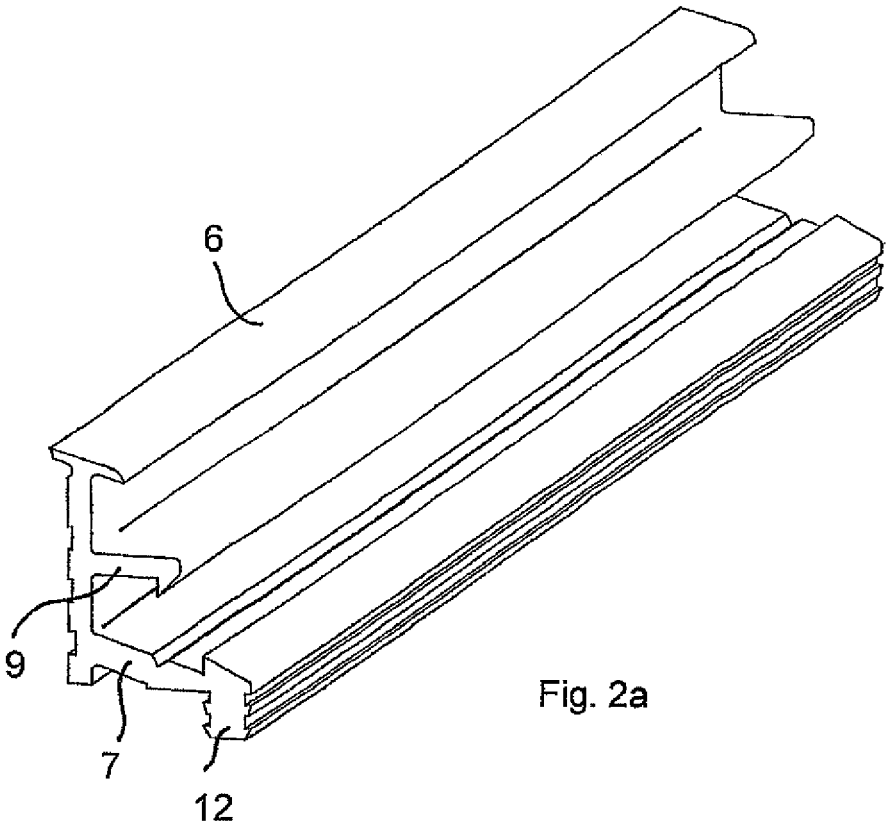
FIGS. 2*a*, 2*b*, 2*c* show a second fastening device for glass panes.
Figure 2B:
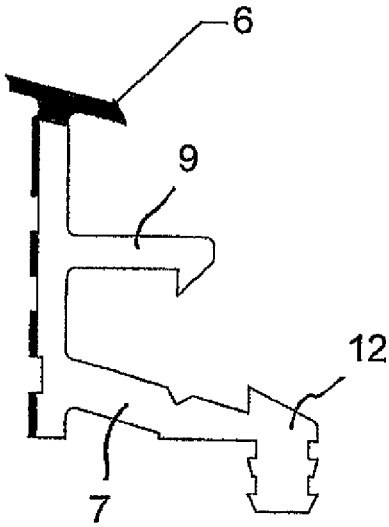
Figure 2C:
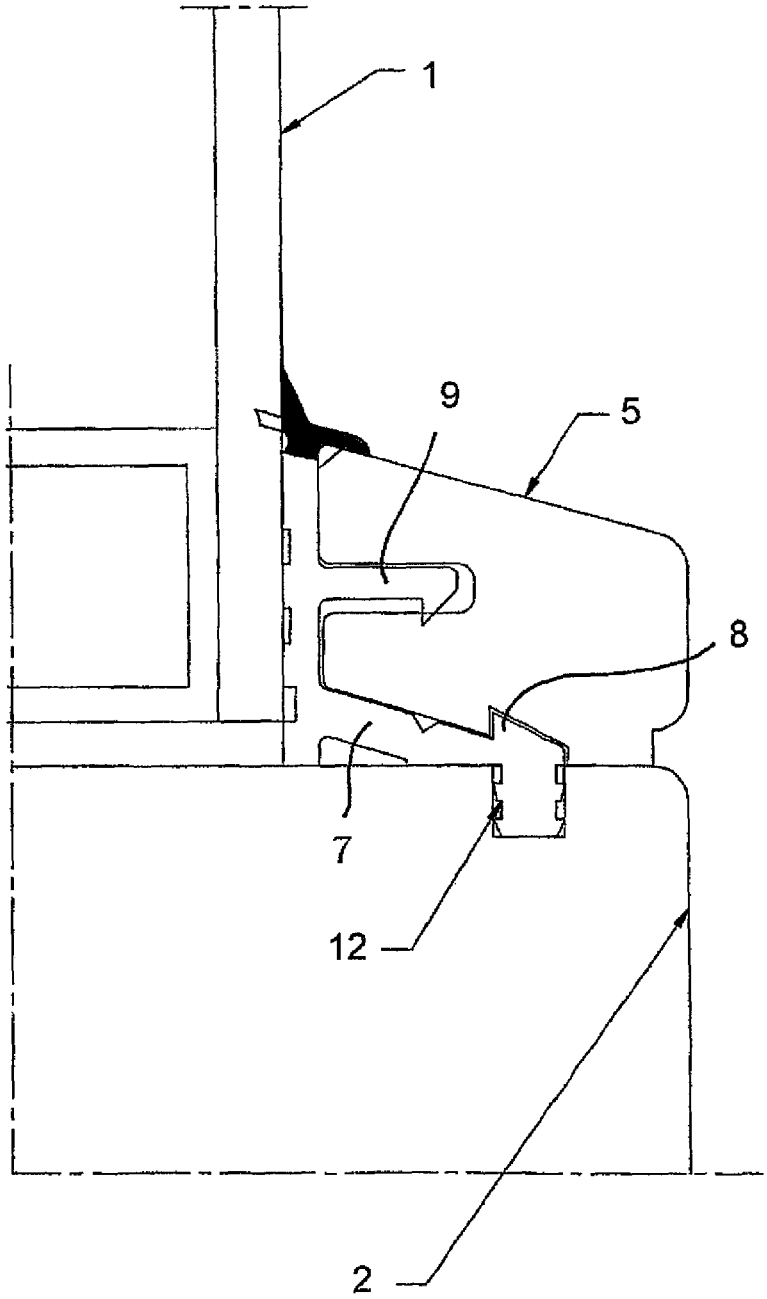

FIGS. 2*a, b* show a fastening arm 7 having a fastening web 12. This fastening web 12 requires a respective groove to be cut into the window frame. This embodiment of the invention enables the assembling to be carried out more quickly, in the site.

Figure 3A:
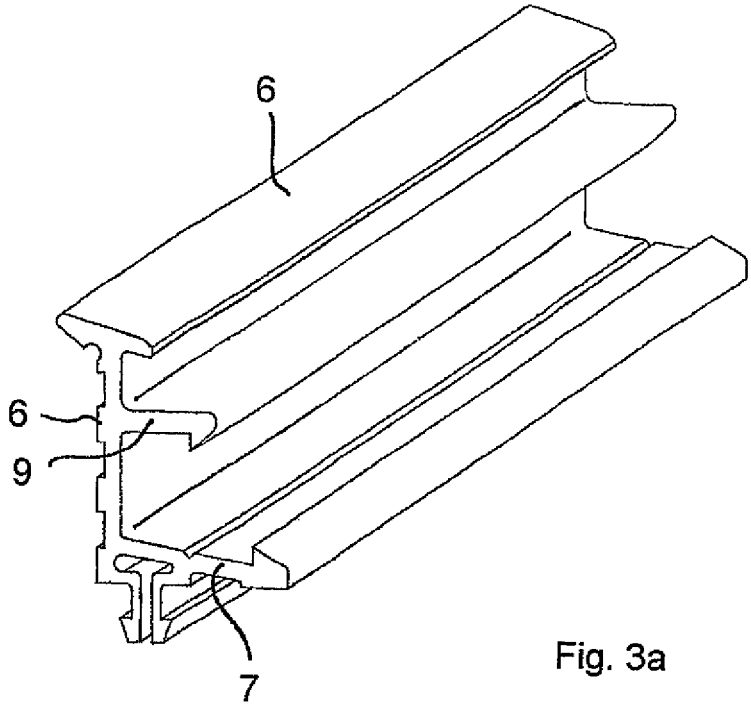
FIGS. 3*a*-*b* show a third fastening device for glass panes.
Figure 3B:
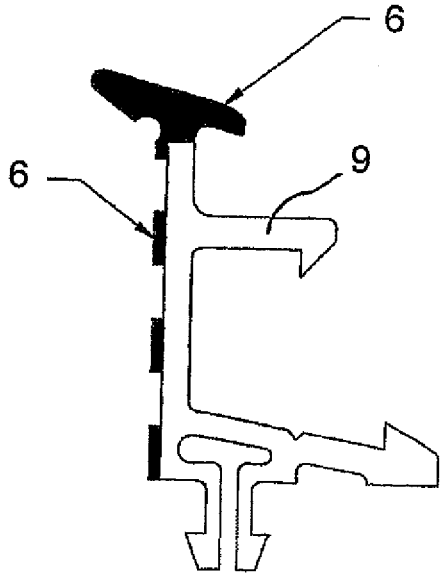

FIGS. 3*a, b* show an embodiment similar to that represented in FIGS. 2*a, b*.

Based on then technical science disclosed and claimed, an expert will be able to find out further embodiments, without having to be active inventively.

The invention claimed is:

1. A fastening device for fastening a glass pane in a wooden or plastic frame, comprising a retaining rail made of elastic plastic and fixable on the frame, said retaining rail having a fastening arm provided with a claw connectable with the frame by fastening elements at a first location, and a clamping arm arranged at a distance to the fastening arm, said retaining rail having a bottom surface provided with a depression for receiving a sealing lip or a sealing tape at a second location which is spaced from said first location;

a clip strip configured for formfitting engagement onto the retaining rail by pre-stress of the clamping arm, said clip strip having a first groove dimensioned for formfitting engagement by the claw of the retaining rail, and a second groove dimensioned for engagement of the clamping arm by a formfit or a combination of form fit and interference fit; and an elastic seal arrangement between the retaining rail and the glass pane, wherein the retaining rail has a free section which is not fixed and pressed against the glass pane by a permanent stressing force such that the seal arrangement between the retaining rail and the glass pane is pressed against the glass pane and, simultaneously, the glass pane is pressed against the seal arrangement between a backside of the glass pane and a stop of the frame.

2. The fastening device of claim 1, wherein the clamping arm of the retaining rail is provided with a claw.

3. The fastening device of claim 1, wherein the fastening arm comprises holes for receiving fixing screws.

4. The fastening device of claim 1, wherein the fastening arm comprises a groove for driving in nails.

5. The fastening device of claim 1, wherein the fastening arm comprises a fastening web.

6. The fastening device of claim 1, wherein the seal arrangement and the retaining rail are formed in one piece.

* * * * *